United States Patent [19]

Price et al.

[11] Patent Number: 4,485,780

[45] Date of Patent: Dec. 4, 1984

[54] COMPRESSION RELEASE ENGINE RETARDER

[75] Inventors: Robert B. Price, Manchester; Stanislav Jakuba, West Hartford, both of Conn.

[73] Assignee: The Jacobs Mfg. Company, Bloomfield, Conn.

[21] Appl. No.: 491,993

[22] Filed: May 5, 1983

[51] Int. Cl.[3] ..... F02D 13/04

[52] U.S. Cl. ..... 123/321; 123/90.12; 123/90.15; 123/198 F

[58] Field of Search ..... 123/90.12, 90.13, 90.15, 123/90.16, 198 F, 321

[56] References Cited

U.S. PATENT DOCUMENTS

| | | | |
|---|---|---|---|
| 3,220,392 | 11/1965 | Cummins | 123/90.12 |
| 3,405,699 | 10/1968 | Laas | 123/90.12 |
| 3,612,015 | 10/1971 | Hausknecht | 123/90.12 |
| 4,033,304 | 7/1977 | Luria | 123/90.12 |
| 4,150,640 | 4/1979 | Egan | 123/90.12 |
| 4,153,016 | 5/1979 | Hausknecht | 123/90.12 |
| 4,188,925 | 2/1980 | Jordan | 123/90.12 |
| 4,271,796 | 6/1981 | Sickler | 123/321 |
| 4,384,558 | 5/1983 | Johnson | 123/321 |
| 4,398,510 | 8/1983 | Custer | 123/198 DB |
| 4,399,787 | 8/1983 | Cavanagh | 123/321 |
| 4,423,712 | 1/1984 | Mayne et al. | 123/321 |

*Primary Examiner*—Ira S. Lazarus

*Attorney, Agent, or Firm*—Donald E. Degling

[57] ABSTRACT

An improved engine retarder of the compression release type in which the exhaust valves are opened near the end of the compression stroke of the engine by a slave piston hydraulically interconnected with a master piston driven by an existing pushtube is provided. The improved engine retarder includes a second master piston interconnected hydraulically in parallel with the first master piston and driven by a separate existing pushtube whereby the timing of the compression release event may be regulated and the stress on the engine pushtubes may be reduced.

9 Claims, 5 Drawing Figures

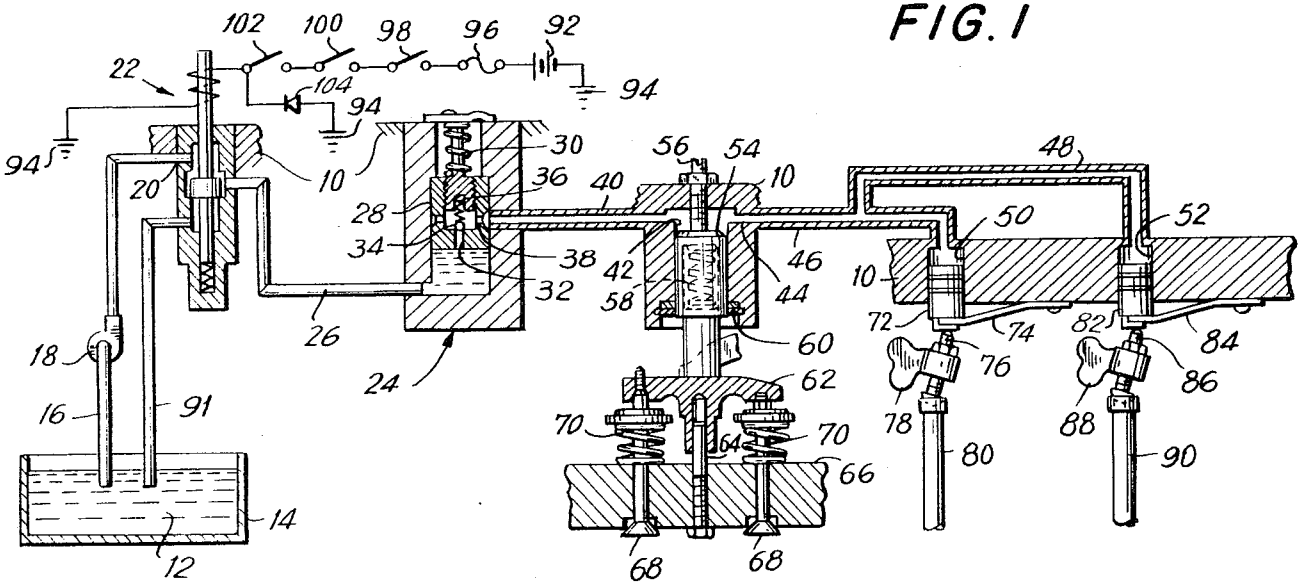
FIG. 1
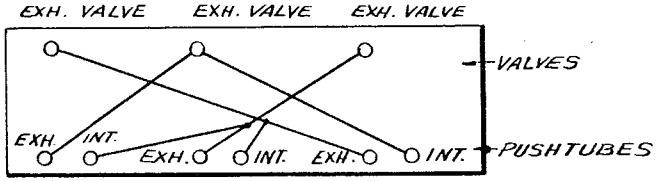
| SLAVE PISTON EXHAUST VALVE | MASTER PISTONS EXHAUST PUSHTUBE | MASTER PISTONS INTAKE PUSHTUBE |
|---|---|---|
| 1 | 2 | 3 |
| 2 | 3 | 1 |
| 3 | 1 | 2 |
FIG. 2A
| SLAVE PISTON EXHAUST VALVE | MASTER PISTONS EXHAUST PUSHTUBE | MASTER PISTONS INTAKE PUSHTUBE |
|---|---|---|
| 4 | 6 | 5 |
| 5 | 4 | 6 |
| 6 | 5 | 4 |
FIG. 2B

COMPRESSION RELEASE ENGINE RETARDER

BACKGROUND OF THE INVENTION

1. Field of the Invention

This invention relates generally to the field of compression release engine retarders for internal combustion engines. More particularly, it relates to a compression release engine retarder employing an hydraulic valve actuating mechanism having two master pistons for each slave piston wherein the master pistons are separately driven by pushtubes associated with the appropriate engine exhaust or intake valves or fuel injectors.

2. Prior Art

Engine retarders of the compression release type are well-known in the art. Such engine retarders are designed to convert, temporarily, an internal combustion engine of the spark ignition or compression ignition type into an air compressor so as to develop a retarding horsepower which may be a substantial portion of the operating horsepower developed by the engine.

As a general rule, so long as the retarding horsepower developed during retarding operations does not exceed the operating horsepower for which the engine was designed, the stresses on the crankshaft, bearings and drive train, though opposite in direction, will not exceed the allowable stresses for these parts and therefore the addition of the compression release retarder will not adversely affect the operating life of the drive train components of the engine and vehicle. At the same time, the engine retarder will supplement the braking capacity of the primary vehicle wheel braking system and extend, substantially, the life of the primary braking system of the vehicle. The basic design for an engine retarding system of the type here involved is disclosed in the Cummins U.S. Pat. No. 3,220,392.

The compression release engine retarder of the type disclosed in U.S. Pat. No. 3,220,392 employs an hydraulic system wherein the motion of a master piston controls the motion of a slave piston which, in turn, opens the exhaust valve of the internal combustion engine near the end of the compression stroke whereby the work done in compressing the intake air is not recovered during the expansion or "power" stroke, but, instead, is dissipated through the exhaust and radiator systems. The master piston is customarily driven by a pushtube controlled by the engine camshaft. It will be apparent that the force required to open the exhaust valve will be transmitted back through the hydraulic system to the pushtube and the camshaft. In order to minimize modification of the engine, it is common to utilize an existing pushtube which moves close to the desired time to operate the engine retarder hydraulic system. In some cases an exhaust valve pushtube associated with another engine cylinder is selected while, in other cases, it is convenient to use the fuel injector pushtube associated with the engine cylinder the exhaust valve for which is to be opened by the slave piston.

However, by assigning a second function to an existing pushtube, the possibility exists that an increased load may be experienced which, under some circumstances, may exceed the design capacity of the pushtube or camshaft. One approach to this problem is shown in the Sickler et al. U.S. Pat. No. 4,271,796 which discloses an automatic pressure relief system to unload the hydraulic system rapidly whenever an overpressure is sensed in the system, and then to reset the system. Another pressure relief system is disclosed in Egan U.S. Pat. No 4,150,640. A pressure unloading system responding to excess motion of the slave piston is disclosed in Laas U.S. Pat. No. 3,405,699. While the pressure unloading systems of the prior art are effective to prevent damage to the valve train and other components of the engine, they necessarily reduce, at least temporarily, the retarding horsepower of the engine.

A disadvantage associated with the use of an existing pushtube to control the hydraulic system of a compression release retarder also resides in the fact that the timing of the pushtube motion is designed for its primary function in the engine and may not be optimum for the compression release retarding function. One approach to this latter problem is disclosed in application Ser. No. 248,344, now U.S. Pat. No. 4,398,510, assigned to the assignee of the present application, which provides a timing advance mechanism whereby the normal clearance or "lash" necessarily incorporated into the valve mechanism to provide for dimensional changes resulting from temperature variation is decreased or eliminated during the compression release retarding operation. The effect of decreasing or eliminating "lash" is to advance the timing of the compression release retarding event so that it approaches an optimum timing. This mechanism, however does not modify the stress on the pushtubes except to the degree that the force required to open an exhaust valve varies with the timing of the compression release event.

SUMMARY OF THE INVENTION

An object of the present invention is to reduce the stress on the pushtubes, camshaft and other elements of the valve train so as to eliminate the need for a pressure relief device and to permit the use of a compression release retarding system in engines where the design of the valve train would not otherwise permit the use of such a system. Another object of the invention is to improve the timing of the compression release retarding event so as to optimize the retarding horsepower developed by the engine. Both objects are accomplished simultaneously by the provision of a second master piston, driven from a second pushtube and connected in parallel with the first master piston, which operates substantially simultaneously with the first master piston to provide a resultant pressure pulse. The resultant pressure pulse rises more rapidly than the pulse produced by each separate master piston and attains a peak value closer to the top dead center (TDC) position than either of its component pulses. The reduced stress on the valve train is accomplished by sharing the force required to open and to hold open the exhaust valve(s) by using two master pistons instead of one master piston. The load shared by each of the master pistons and its associated valve train components i.e.: pushtube, camshaft, etc. is proportional to the relative areas of the two master pistons in the hydraulic circuit.

DESCRIPTION OF THE DRAWINGS

FIG. 1 is a schematic diagram of a compression release engine retarder containing twin master pistons in accordance with the present invention.

FIG. 2A is a diagram and a table showing the hydraulic interconnection between the master pistons and the slave pistons for Cylinder Nos. 1, 2 and 3 of a six cylinder engine incorporating the present invention.

FIG. 2B is a diagram and a table similar to FIG. 2A showing the hydraulic interconnection for Cylinders Nos. 4, 5 and 6 of a six cylinder engine incorporating the present invention.

DETAILED DESCRIPTION OF THE INVENTION

Figure 3B:
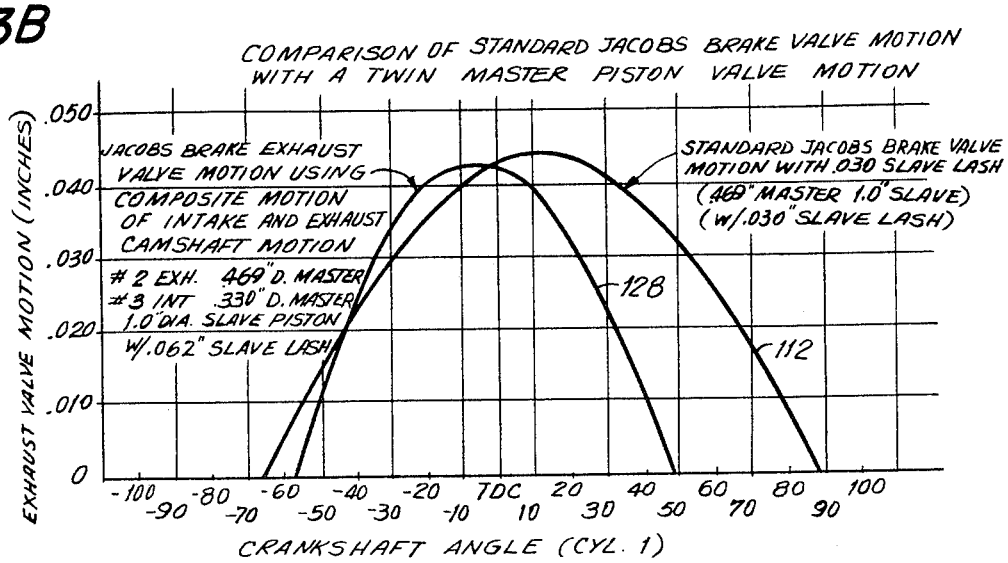
FIG. 3B is a graph wherein the motion of the exhaust valve produced in accordance with the present invention is compared with motion of the exhaust valve produced by a standard compression release engine retarder.

FIG. 1 is a schematic diagram of a compression release engine retarder adapted for use in conjunction with an internal combustion engine of the spark ignition or compression ignition type. As noted above, the basic design of the compression release engine retarder is disclosed in the Cummins U.S. Pat. No. 3,220,392. For purposes of simplicity and clarity, the present invention will be described primarily in reference to an engine retarder applied to a Cummins compression ignition engine in which the master pistons of the engine retarder are driven by intake and exhaust valve pushtubes associated with engine cylinders other than the cylinder undergoing the compression release event. It will be understood that the invention may be applied to compression release retarders driven, for example, by fuel injector pushtubes and to engines having other than six cylinders.

Referring now to FIG. 1, the numeral 10 represents a housing fitted on an internal combustion engine within which the components of a compression release engine retarder are contained. Oil 12 from a sump 14 which may be, for example, the engine crankcase is pumped through a duct 16 by a low pressure pump 18 to the inlet 20 of a solenoid valve 22 mounted in the housing 10. Low pressure oil 12 is conducted from the solenoid valve 22 to a control cylinder 24 through a duct 26. A control valve 28 is fitted for reciprocating movement within the control cylinder 24 and is biased toward a closed position by a compression spring 30. The control valve 28 contains an inlet passage 32 closed by a ball check valve 34 which is biased into the closed position by a compression spring 36, and an outlet passage 38. When the control valve 28 is in the open position (as shown in FIG. 1) the outlet passage 38 registers with the control cylinder outlet duct 40 which communicates with the inlet of a slave cylinder 42 also formed in the housing 10. It will be understood that low pressure oil 12 passing through the solenoid valve 22 enters the control valve cylinder 24 and raises the control valve 28 to the open position. Thereafter, the ball check valve 34 opens against the bias of spring 36 to permit the oil 12 to flow into the slave cylinder 42. From the outlet 44 of the slave cylinder 42 the oil 12 flows through a duct 46 and a branch duct 48 into master cylinders 50 and 52 respectively. Master cylinders 50 and 52 are formed in the housing 10.

A slave piston 54 is fitted for reciprocating motion within the slave cylinder 42. The slave piston 54 is biased in an upward direction (as shown in FIG. 1) against an adjustable stop 56 by a compression spring 58 which is mounted within the slave piston 54 and acts against a bracket 60 seated in the slave cylinder 42. The lower end of the slave piston 54 acts against a crosshead 62 fitted for reciprocating motion on a pin 64 fastened to the cylinder head 66 of the internal combustion engine. The crosshead 62, in turn, acts against the stems of exhaust valves 68 which are moveably seated in the cylinder head 66. The exhaust valves 68 are normally biased toward a closed position (as shown in FIG. 1) by valve springs 70. Normally, the adjustable stop 56 is set to provide a minimum clearance (i.e. "lash") of at least 0.018 inch between the slave piston 54 and the crosshead 62 when the exhaust valves 68 are closed, the slave piston 54 is seated against the adjustable stop 56 and the engine is cold. This clearance is required and is normally sufficient to accommodate expansion of the parts comprising the exhaust valve train when the engine is hot without opening the exhaust valves 68.

A first master piston 72 is fitted for reciprocating movement within the master cylinder 50 and biased in an upward direction (as shown in FIG. 1) by a light leaf spring 74. The lower end of the master piston 72 contacts an adjusting screw mechanism 76 for the rocker arm 78 actuated by a push tube 80 driven from the engine camshaft (not shown). Similarly, a second master piston 82 is fitted for reciprocating movement within the master cylinder 52 and biased in an upward direction (as shown in FIG. 1) by a light leaf spring 84. The lower end of the master piston 82 contacts an adjusting screw mechanism 86 for the rocker arm 88 actuated by a pushtube 90 driven from the engine crankshaft (not shown). Referring to FIG. 1, if the valves 68 are associated with Cylinder No. 1, then the pushtubes 80 and 90 which drive the master pistons 72 and 82 will be the pushtubes associated respectively with the exhaust valve for Cylinder No. 2 and the intake valve for Cylinder No. 3. FIG. 1 shows diagrammatically the arrangement of the compression release retarder applied to one cylinder of an engine. In practice there will be a slave piston and two master pistons for each cylinder of the engine. While one solenoid valve 22 and one control valve 28 are adequate to operate the compression relief retarder for all cylinders, it may be desirable in engines having, for example, two banks of three cylinders each to provide separate solenoid and control valves for each bank.

FIGS. 2A and 2B show in diagrammatic and tabular form the hydraulic interconnections for a six cylinder engine wherein a slave piston is associated with each of the dual or single exhaust valves and dual master pistons are driven by each exhaust and intake pushtube. It will be appreciated that, so far as the hydraulic interconnections are concerned, each bank of three cylinders is independent so that all of the necessary ducts connecting the master cylinders and the slave cylinder can be located within the housing 10 provided for each bank of cylinders.

Operation of the mechanism described up to this point is as follows: when the solenoid valve 22 is opened, oil 12 will raise the control valve 28 and then fill the slave cylinder 42 and both master cylinders 50 and 52. Reverse flow of oil out of the slave cylinder 42 is prevented by the action of the ball check valve 34. However, once the system is filled with oil (or other hydraulic fluid), upward movement of the pushtubes 80 and 90 will drive the master pistons 72 and 82 upwardly and the hydraulic pressure, in turn, will drive the slave piston 54 downwardly so as to open the exhaust valves 68. As will be explained in more detail below, the mechanism is designed so that the exhaust valves 68 are opened near the end of the compression stroke of the cylinder with which the exhaust valves 68 are associated. Thus, the work done by the engine piston in compressing air during the compression stroke is released to the exhaust and radiator systems of the engine and not recovered during the expansion or "power" stroke of the engine.

When it is desired to deactivate the compression release retarder, the solenoid valve 22 is closed whereby the oil 12 in the control cylinder 24 passes through the duct 26, the solenoid valve 22 and the return duct 91 to the sump 14, thereby causing the control valve 28 to drop downwardly (as viewed in FIG. 1). When the control valve 28 drops to its closed position, a portion of the oil in the slave cylinder 42 and master cylinders 50 and 52 is vented past the control valve 28 and returned to the sump 14 by duct means (not shown).

The electrical control system for the engine retarder includes the vehicle battery 92 which is grounded at 94. The hot terminal of the battery 92 is connected, in series, to a fuse 96, a dash switch 98, a clutch switch 100, a fuel pump switch 102, and preferably, through a diode 104 back to ground 94. As shown in FIG. 1 the control circuit also includes the coil of the solenoid valve 22. The switches 98, 100 and 102 are provided to assure the safe operation of the system. Switch 98 is a manual control mounted on the vehicle dashboard and accessible to the vehicle driver to deactivate the entire system. Switch 100 is an automatic switch connected to the vehicle clutch to deactivate the system whenever the clutch is disengaged so as to prevent engine stalling. Switch 102 is a second automatic switch connected to the fuel system to prevent engine fueling when the engine retarder is in operation.

Figure 3A:
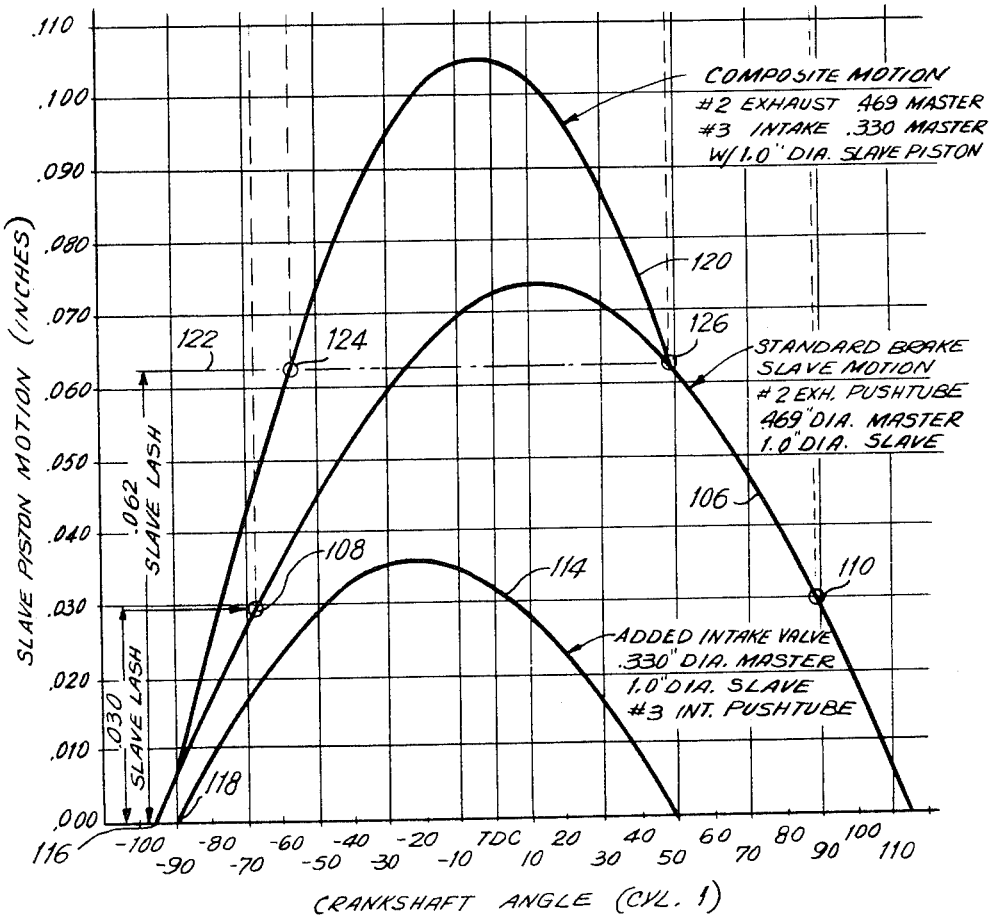
FIG. 3A is a graph in which slave piston motion is plotted as the ordinate and crankshaft angle is plotted as the abscissa. The motion of the slave piston produced by each master piston and the motion produced by the combination of both master pistons are depicted.

Reference is now made to FIG. 3A which is a graph of slave piston motion for one cylinder as a function of the rotation of the crankshaft, in this instance, Cylinder No. 1. Curve 106 shows the motion of the slave piston 54 in the standard compression release engine retarder having a single master piston, e.g. master piston 72, for each slave piston. In this example, the slave piston for Cylinder No. 1 has a diameter of 1.000 inch and is driven by a master piston having a diameter of 0.469 inch. The master piston is driven by the exhaust valve pushtube for Cylinder No. 2. Points 108 and 110 represent a movement of 0.030" by the slave piston from a rest position during which the predetermined clearance or lash of 0.030 inch in the valve train is taken up. The portion of curve 106 above a line passing through points 108 and 110 also represents the motion of the exhaust valves 68 produced by the motion of the slave piston and may be regarded as the effective or useful motion of the slave piston. This has been replotted as curve 112 in FIG. 3B. The lash of 0.030" was set so as to obtain the desired exhaust valve travel during the retarding operation.

Returning to FIG. 3A, curve 114 is a curve similar to curve 106 but represents the motion of the slave piston due to a second master piston, e.g. master piston 82, driven by the pushtube for the intake valve of Cylinder No. 3. In this example, a 1.000 inch diameter slave piston is driven by a 0.330 inch diameter master piston. Because the master piston for curve 114 is smaller than the master piston for curve 106, the area under curve 114 is smaller. It will be appreciated that the areas under curves 106 and 114 respectively are proportional to the volume of hydraulic fluid displaced by each respective master piston. The initial points 116 and 118 of the respective curves 106 and 114 are determined by the basic design of the engine camshaft which drives the respective pushtubes 80 and 90.

Since curves 106 and 114 represent the components of motion of the slave piston 54 due to the motion of the separate master pistons 72 and 82, the actual motion of the slave piston 54 is shown by the sum of curves 106 and 114. This sum or composite is represented by curve 120. As only about 0.040 to 0.045 inches of exhaust valve motion is required to accomplish the compression release function, the clearance or "lash" in the slave piston motion as shown in FIG. 3A has been increased to 0.062 inch as indicated by line 122 which intercepts the curve 120 at points 124 and 126. The region above line 122 on curve 120 which is the useful or effective portion of the curve has been replotted as curve 128 in FIG. 3B where it represents the motion of the exhaust valve 68 produced when both master pistons 72 and 82 are utilized in accordance with the present invention.

A comparison of curves 128 and 112 reveals that the compression release event is advanced to more closely approach the top dead center position of the affected engine cylinder. Moreover, the motion of the exhaust valve required by the compression release function is completed almost 40 crank angle degrees sooner by the apparatus in accordance with the present invention. By modifying the timing of the compression release event to more nearly approach the top dead center position of the engine piston, applicants maximize the engine retarding effect of the mechanism. At the same time, prompt closing of the exhaust valves at the conclusion of the compression release event insures that the compression release mechanism will have no effect upon the subsequent normal opening of the exhaust valves.

Although maximizing the engine retarding effect may imply an increase in the force required to open the exhaust valves, it will be appreciated that this opening force is now shared by two master pistons driven by separate pushtubes. Thus, even if the total load should increase, the load on each pushtube is reduced and, therefore, the risk of damage to each pushtube is reduced.

It will be appreciated that the precise shape of the composite curve 120 is determined by the relative magnitudes of the component curves 106 and 114. The magnitudes of these latter curves are a function of the diameters of the respective master pistons if the slave piston diameter remains constant. Inspection of FIG. 3A reveals that increasing the diameter of the master piston associated with the intake valve will advance the timing of the compression release event while increasing the diameter of the master piston associated with the exhaust pushtube will retard the timing of the compression release event. It will also be appreciated that the pushtube load is a function of the diameter of the master piston associated with that pushtube. This effect suggests that both master pistons should be about the same diameter. The final design of the mechanism will ordinarily be a compromise in which the optimum timing and the allowable pushtube load are both considered in the light of the characteristics of the engine involved.

It has been pointed out above, and it is apparent from FIGS. 3A and 3B, that the exhaust valve motion can be varied by varying the clearance or "lash" in the system. Thus, curve 128 in FIG. 3B is one member of a family of curves determined by the location of the line 122 in FIG. 3A. It will also be understood that the height of the curve 120 varies with the diameter of the slave piston. The design in accordance with the present invention is, therefore, quite flexible and may be adapted to many engines having different valve timing characteristics and pushtube loadings. In particular, the apparatus of the present invention may be incorporated into engines previously unsuitable for compression release retarders due to limitations in the design of the pushtubes or camshaft.

It has been noted above that certain engines may be equipped with fuel injectors driven from the engine camshaft through a set of pushtubes. In such circumstances, the master pistons of the existing retarder mechanism may be driven by the fuel injector pushtube. Since the fuel injector is operated near the end of the compression stroke of the cylinder, it will be apparent that the fuel injector pushtube for Cylinder No. 1 may be used to open the exhaust valve for Cylinder No. 1. The present invention may be applied to such engines by providing a second master piston for each cylinder driven by either an exhaust pushtube or an intake pushtube.

The appropriate pushtubes for the second master piston may be selected from FIGS. 2A and 2B. More specifically, and with reference to FIG. 2A, if it is desired to open the exhaust valve for Cylinder No. 1, the second master piston may be driven by either the exhaust pushtube for Cylinder No. 2 or the intake pushtube for Cylinder No. 3. Similarly, to open the exhaust valve for Cylinder No. 2, the second master piston may be driven by either the exhaust pushtube for Cylinder No. 3 or the intake pushtube for Cylinder No. 1. Since timing for the fuel injector, intake and exhaust pushtubes is fixed for a particular engine, it will be apparent that by selecting the desired intake or exhaust pushtube and by appropriate sizing of the master pistons and slave piston, the performance of the retarder can be improved and the pushtube stress decreased.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. In an engine braking system of a gas compression release type including an internal combustion engine having intake valve means and exhaust valve means and pushtube means associated with each of said intake valve means and exhaust valve means, hydraulically actuated first piston means associated with said exhaust valve means to open said exhaust valve means at a predetermined time and second piston means actuated by said pushtube means associated with said exhaust valve means and hydraulically interconnected with said first piston means, the improvement comprising third piston means actuated by said pushtube means associated with said intake valve means and hydraulically interconnected with said first piston means and said second piston means.

2. An apparatus as described in claim 1 in which the exhaust valve for Cylinder No. 1 is controlled by the second piston means driven by the exhaust pushtube for Cylinder No. 2 and the third piston means driven by the intake pushtube for Cylinder No. 3, the exhaust valve for Cylinder No. 2 is controlled by the second piston means driven by the exhaust pushtube for Cylinder No. 3 and the third piston means driven by the intake pushtube for Cylinder No. 1, the exhaust valve for Cylinder No. 3 is controlled by the second piston means driven by the exhaust pushtube for Cylinder No. 1 and the third piston means driven by the intake pushtube for Cylinder No. 2, the exhaust valve for Cylinder No. 4 is controlled by the second piston means driven by the exhaust pushtube for Cylinder No. 6 and the third piston means driven by the intake pushtube for Cylinder No. 5, the exhaust valve for Cylinder No. 5 is controlled by the second piston means driven by the exhaust pushtube for Cylinder No. 4 and the third piston means driven by the intake pushtube for Cylinder No. 6 and the exhaust valve for Cylinder No. 6 is controlled by the second piston means driven by the exhaust pushtube for Cylinder No. 5 and the third piston means driven by the intake pushtube for Cylinder No. 4.

3. An apparatus as described in claims 1 or 2 in which the diameters of the second and third piston means are substantially equal whereby the loads carried by the pushtubes associated with said second and third piston means are substantially equal.

4. An apparatus as described in claims 1 or 2 in which the relative diameters of the second and third piston means are regulated so that the said first piston means opens the said exhaust valve substantially at the top dead center position of the engine cylinder with which said exhaust valve is associated.

5. In an engine braking system of a gas compression release type including an internal combustion engine having intake valve means, exhaust valve means and fuel injector means and pushtube means associated with each of said intake valve means, exhaust valve means and fuel injector means, hydraulically actuated first piston means associated with said exhaust valve means to open said exhaust valve means at a predetermined time and second piston means actuated by said pushtube means associated with said fuel injector means and hydraulically interconnected with said first piston means, the improvement comprising third piston means actuated by said pushtube means associated with one of said exhaust valve means and said intake valve means and hydraulically interconnected with said first piston means and said second piston means.

6. An apparatus as described in claim 5 in which the exhaust valve for Cylinder No. 1 is controlled by the second piston means driven by the fuel injector pushtube for Cylinder No. 1 and the third piston means driven by the intake pushtube for Cylinder No. 3, the exhaust valve for Cylinder No. 2 is controlled by the second piston means driven by the fuel injector pushtube for Cylinder No. 2 and the third piston means driven by the intake pushtube for Cylinder No. 1, the exhaust valve for Cylinder No. 3 is controlled by the second piston means driven by the fuel injector pushtube for Cylinder No. 3 and the third piston means driven by the intake pushtube for Cylinder No. 2, the exhaust valve for Cylinder No. 4 is controlled by the second piston means driven by the fuel injector pushtube for Cylinder No. 4 and the third piston means driven by the intake pushtube for Cylinder No. 5, the exhaust valve for Cylinder No. 5 is controlled by the second piston means driven by the fuel injector pushtube for Cylinder No. 5 and the third piston means driven by the intake pushtube for Cylinder No. 6 and the exhaust valve for Cylinder No. 6 is controlled by the second piston means driven by the fuel injector pushtube for Cylinder No. 6 and the third piston means driven by the intake pushtube for Cylinder No. 4.

7. An apparatus as described in claim 5 in which the exhaust valve for Cylinder No. 1 is controlled by the second piston means driven by the fuel injector pushtube for Cylinder No. 1 and the third piston means driven by the exhaust pushtube for Cylinder No. 2, the exhaust valve for Cylinder No. 2 is controlled by the second piston means driven by the fuel injector pushtube for Cylinder No. 2 and the third piston means driven by the exhaust pushtube for Cylinder No. 3, the exhaust valve for Cylinder No. 3 is controlled by the second piston means driven by the fuel injector pushtube for Cylinder No. 3 and the third piston means driven by the exhaust pushtube for Cylinder No. 1, the exhaust valve for Cylinder No. 4 is controlled by the second piston means driven by the fuel injector pushtube for Cylinder No. 4 and the third piston means driven by the exhaust pushtube for Cylinder No. 6, the exhaust valve for Cylinder No. 5 is controlled by the second piston means driven by the fuel injector pushtube for Cylinder No. 5 and third piston means driven by the exhaust pushtube for Cylinder No. 4 and the third exhaust valve for Cylinder No. 6 is controlled by the second piston means driven by the fuel injector pushtube for Cylinder No. 6 and the third piston means driven by the exhaust pushtube for Cylinder No. 5.

8. An apparatus as described in claims, 5, 6, or 7 in which the diameters of the second and third piston means are substantially equal whereby the loads carried by the pushtubes associated with said second and third piston means are substantially equal.

9. An apparatus as described in claims 5, 6 or 7 in which the relative diameters of the second and third piston means are regulated so that the said first piston means opens the said exhaust valve substantially at the top dead center position of the engine cylinder with which said exhaust valve is associated.

* * * * *